US005301823A

United States Patent [19]

Kingery

[11] Patent Number: 5,301,823

[45] Date of Patent: Apr. 12, 1994

[54] RACK FOR HANGING MUSICAL INSTRUMENTS

[76] Inventor: Carl D. Kingery, 12 Orchard Ave., Newark, Del. 19711

[21] Appl. No.: 95,308

[22] Filed: Jul. 20, 1993

Related U.S. Application Data

[63] Continuation of Ser. No. 972,700, Nov. 6, 1992, abandoned.

[51] Int. Cl.[5] ..... A47F 7/00

[52] U.S. Cl. ..... 211/87; 211/88

[58] Field of Search ..... 211/87, 59.1, 88

[56] References Cited

U.S. PATENT DOCUMENTS

| | | | |
|---|---|---|---|
| 2,607,497 | 8/1952 | Carlini | 211/87 |
| 3,285,426 | 11/1966 | Wilcke | 211/87 X |
| 3,565,383 | 2/1971 | Friede | 211/87 X |
| 3,938,667 | 2/1976 | Buckland | 211/87 |
| 4,805,784 | 2/1989 | Solheim et al. | 211/59.1 X |
| 5,083,668 | 1/1992 | Bushey | 211/87 X |

OTHER PUBLICATIONS

Advertisement for Original Guitar Wings.

*Primary Examiner*—Alvin C. Chin-Shue
*Assistant Examiner*—Sarah A. Lechok
*Attorney, Agent, or Firm*—Baker & McKenzie

[57] ABSTRACT

An improved rack for the ornamental display of stringed instruments is shown and described. The rack mounts against a vertical wall and is fully adjustable thereby accommodating instruments of varying neck widths and head sizes and orientations. The rack is easy to install and use and further is aesthetically pleasing for the ornamental display of stringed instruments on walls in homes, apartments and offices. The rack provides a safe means for storing string instruments while maintaining accessibility of the instrument.

16 Claims, 1 Drawing Sheet

RACK FOR HANGING MUSICAL INSTRUMENTS

This application is a continuation of application Ser. No. 07/972,700, filed Nov. 6, 1992 now abandoned.

This invention relates generally to an improved rack for hanging guitars and other stringed instruments from a vertical wall. The rack includes two outwardly protruding pegs whose positions are adjustable thereby enabling the rack to accommodate a wide variety of acoustic guitars, electric guitars and other stringed instruments. The rack includes two outwardly protruding pegs whose positions and lengths are adjustable.

BACKGROUND OF THE INVENTION

The general concept of a guitar rack or racks for hanging stringed instruments from vertical walls is known in the art. Specifically, in musical stores, it is well-known to hang guitars from walls using pegboard displays. Guitars are also displayed from stands that rest on the floor.

However, little has been provided for the hanging of guitars and other stringed instruments from a wall in a home, apartment or office. The only racks presently available are utilitarian in design and do not satisfy the aesthetic requirements of the consumer. Further, the only guitar racks presently available are not readily adjustable and therefore do not accommodate a wide variety of guitar sizes and styles. Specifically, acoustic guitars generally have wider necks than electric guitars. Additionally, the heads of electric guitars may also be mounted to the distal end of the neck at an angle and therefore the guitar will not hang straight from a two-pronged rack if the prongs are disposed at the same elevation.

The advantages of hanging a guitar or other stringed instruments from a wall are four-fold. First, hanging the guitar or instrument from the head enables the weight of the body of the guitar to counteract bonding forces applied to the neck by the tension of the strings. A straight neck is extremely important to the guitar player. Second, hanging a guitar on a wall keeps the guitar readily accessible. Third, since guitars and other stringed instruments are normally attractive instruments, it enables the guitar owner to proudly display his/her instrument as a wall decoration. And fourth, hanging a guitar on a wall is a safe way to store a guitar because nothing will be dropped on it and it can be hung out of reach from small children.

Therefore, there is a need for an attractive-looking guitar or instrument rack for mounting stringed instruments on walls of homes, apartments, offices and museums. Ideally, the guitar rack should be adjustable to accommodate guitar necks of different widths and guitar heads of different shapes and sizes. While the rack should be aesthetically pleasing, it should also be easy to mount to a standard wall made of perhaps, one-half inch drywall material.

SUMMARY OF THE INVENTION

The present invention makes a significant contribution to the art by providing an aesthetically pleasing rack for hanging musical instruments on a vertical wall, or a substantially vertical wall. It will be understood that the rack of the present invention is applicable for hanging guitars and other stringed instruments, both acoustic and electric.

The rack includes a base plate which is attached to the wall. The base plate may be made of wood or other suitable material. The instrument is suspended from two pegs that extend perpendicularly outward from the base plate. Each peg is mounted to the base plate with a screw or bolt that extends from the rear surface of the base plate through a slot and down the axial center of the peg. Each slot in the base plate includes a vertical passageway and a lateral passageway. To adjust the relative vertical or lateral position of one peg with respect to another peg, the peg is twisted so that the screw (or bolt) is loosened and the peg and screw are moved along either the vertical or lateral passageway to adjust the position of the peg relative to the other peg.

In the preferred embodiment, the slots are L-shaped with the two lateral passageways spaced apart from each other at the same vertical level and the two vertical passageways extending in opposite directions, one up and one down. This preferred orientation enables lateral and vertical adjustment of each peg with respect to the other peg.

The pegs are available in varying lengths because proper peg length is required to safely hang a guitar. Specifically, for deep-bodied guitars, or guitars with resonating bodies that are from 3" to 6" deep, longer pegs are required because the rear side of the deep body of the guitar engages the wall and prevents the head from being able to be hung between shorter pegs. In contrast, shorter pegs are required for thin-bodied guitars, such as electric guitars with bodies only 1½" to 2" thick. If a thin guitar is hung from longer pegs, the guitar body will be suspended outward from the wall and the guitar will be able to twist without the body engaging the wall. If the guitar is permitted to twist substantially before the body engages the wall, the head may slip through the pegs and the guitar will come crashing downward.

Pegs of varying length may also be required due to the various head configurations available on guitars. For example, some electric guitar heads angle rearward away from the front of the guitar and toward the wall when the guitar is mounted on a wall. In this example, longer pegs are required because of the interference between the rearwardly protruding head and the wall.

The inner end of the peg may be integral with the peg or a separate base extension attached thereto. The inner ends are preferably wide enough to cover and conceal the slots in the base plate. If the peg is mounted on a wide base extension, the base extension is preferably wide enough to cover the slots. Preferably, the base extensions include decorative grooves or rings further adding to the aesthetic appeal of the rack.

The distal or outer ends of the pegs include a knob that precludes the neck of the instrument from sliding off the rack. In addition, the middle portion of the pegs may be covered with a rubber or other polymeric material that serves two purposes. First, the soft rubber will protect the neck of the guitar from scratches or wear and, second, the soft rubber will further preclude the neck and head of the instrument from sliding off the rack.

It is therefore an object of the present invention to provide an improved instrument rack that is both highly functional and aesthetically pleasing.

Yet another object of the present invention is to provide an instrument rack with horizontal pegs that are adjustable both vertically and laterally to enable the instrument rack to satisfactorily support a wide variety of acoustic and electric stringed instruments.

Yet another object of the present invention is to provide an improved instrument rack that safely supports a guitar or other stringed instrument without the danger of the guitar or instrument from falling out of the rack and on to the floor.

Still another object of the present invention is to provide an improved adjustable instrument rack for home use that is easy to install and use.

BRIEF DESCRIPTION OF THE DRAWINGS

This invention is illustrated more or less diagrammatically in the accompanying drawings, wherein.

DETAILED DESCRIPTION OF THE INVENTION

Figures 1, 2, 3, 4, 5, 6, 7, 8, 9, 10, 11, 12, 13:
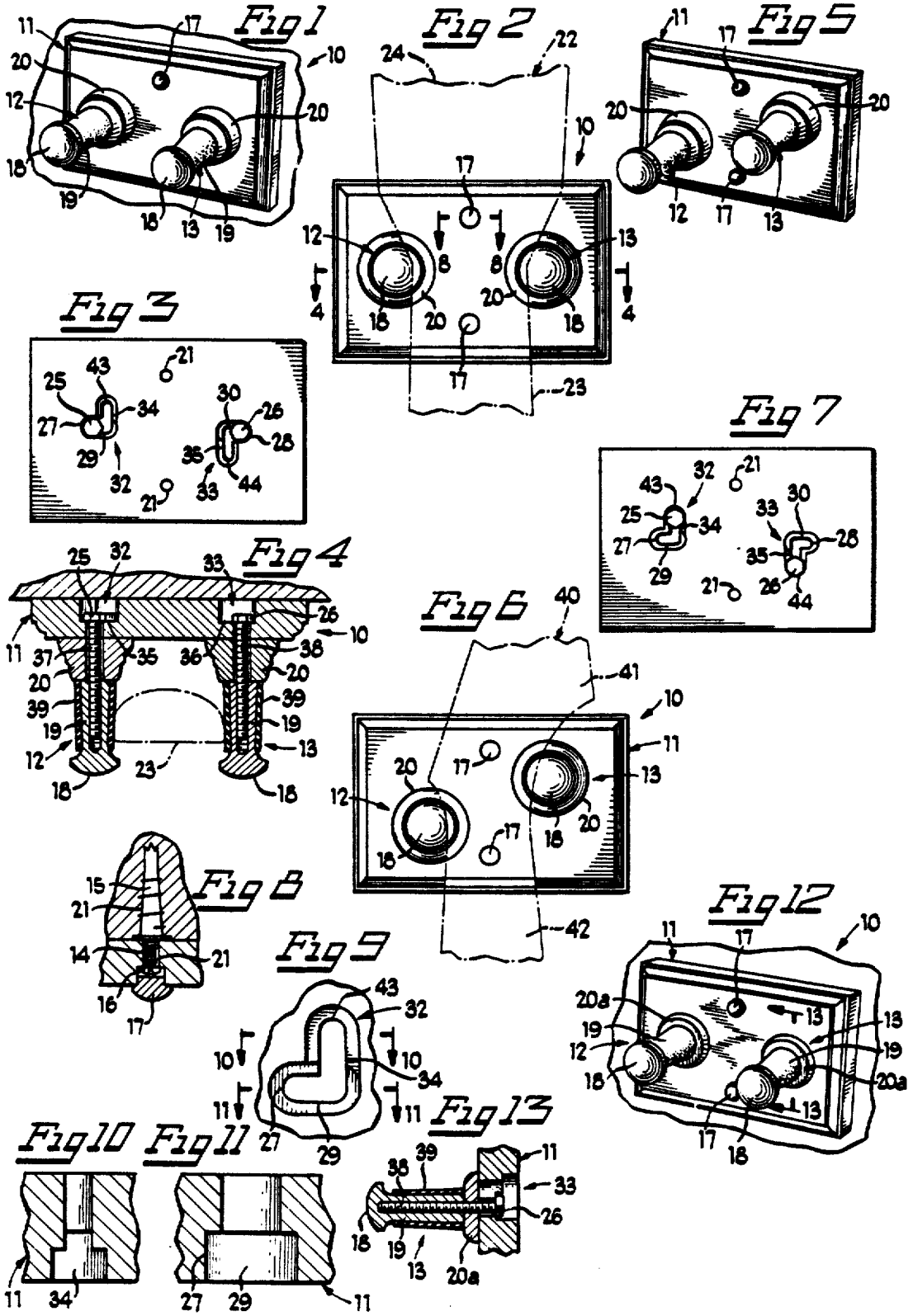
FIG. 1 is a perspective view of the instrument rack made in accordance with the present invention.
FIG. 2 is a front elevational view of the instrument rack shown in FIG. 1 with a guitar neck and head shown in phantom.
FIG. 3 is a rear elevational view of the guitar rack shown in FIG. 1, the pegs being adjusted to have the same elevation and a wide displacement.
FIG. 4 is a sectional view taken substantially along line 4—4 of FIG. 2.
FIG. 5 is a perspective view of the guitar rack shown in FIG. 1 with pegs adjusted for a guitar neck and head shown in phantom in FIG. 6.
FIG. 6 is a front plan view of the instrument rack shown in FIG. 5 with a guitar neck and head shown in phantom.
FIG. 7 is a rear elevational view of the instrument rack shown in FIG. 5.
FIG. 8 is a sectional view taken substantially along line 8—8 of FIG. 2.
FIG. 9 is a detailed view of a slot disposed in the base plate made in accordance with the present invention.
FIG. 10 is a sectional view taken substantially along line 10—10 of FIG. 9.
FIG. 11 is a sectional view taken substantially along line 11—11 of FIG. 9.
FIG. 12 is a perspective view of an instrument rack made in accordance with the present invention showing an alternative and shorter peg construction.
FIG. 13 is a sectional view taken substantially along line 13—13 of FIG. 12.

Like reference numerals will be used to refer to like or similar parts from Figure to Figure in the following description of the drawings.

The dramatic improvement contributed by the present invention is best understood after consideration of a conventional guitar or instrument rack taught by the prior art. One guitar rack currently available for home use includes a forked-shaped prong. The only way for the user to adjust the separation of the two prongs is to grasp the metal prongs and bend them either inward or outward. This design is disadvantageous for two reasons. First, the forked-shaped prong is not aesthetically pleasing and is therefore less desirable for home use. Second, the rack and/or wall may be damaged if one attempts to adjust the width of the prongs while the rack is mounted to the wall.

As seen in FIG. 1, the disadvantages of the prior art are overcome by the instrument rack 10. The rack 10 includes a base plate 11 and two pegs 12, 13. The base plate is mounted firmly to the wall with two screws 14 and anchors 15 (see FIG. 8). For aesthetic purposes, the screw heads 16 and holes 21 (see FIG. 8) are covered with hole covers 17.

The pegs 12, 13 consist of three primary parts: the distal end or knob 18; the middle portion 19; and the inner end or extension 20. The inner end 20 has a outer periphery wide enough to cover the slots 32, 33 (see FIG. 3) which provide the means for attaching the pegs 12, 13 to the base plate 11.

FIG. 2 shows a front plan view of the instrument rack 10 with a guitar head 22 shown in phantom. Because the guitar head 10 22 shown in FIG. 2 includes a relatively wide neck 23 with a head 24 that is symmetrically mounted onto the end of the neck 23, it is appropriate for the pegs 12, 13 to be adjusted to the same elevation indicated at line 4—4. Turning to FIG. 3, the orientation of the pegs 12, 13 shown in FIG. 2 is achieved by disposing the screw heads 25, 26 at the outer ends 27, 28 of the lateral passageways 29, 30 of the slots, shown generally at 32, 33. Because a wide displacement of the pegs 12, 13 is required for the guitar 22 shown in FIG. 2, only the lateral passageways 29, 30 of the slots 32, 33 are utilized and the vertical passageways 34, 35 are not utilized for the peg displacement shown in FIGS. 2 through 4.

Turning to FIG. 4, the detailed construction of the pegs 12, 13 and the means for mounting the pegs 12, 13 to the base plate 11 are illustrated. The pegs 12, 13 include a distal end 18 or knob 18 which precludes the guitar neck 23 from slipping out of the rack 10. The middle portions 19 include an outer covering 39 made of rubber or other polymeric material that not only prevents scratches or wear to the guitar neck 23 but also precludes the neck 23 from slipping out of the rack 10.

In the embodiment illustrated in FIG. 4, the inner ends 20 of the pegs 12, 13 are separate extensions mounted to the middle portions 19 of the pegs. The extensions or inner ends 20 shown in FIG. 4 are fairly thick for acoustic guitars or other instruments having thick or deep bodies; the extensions or inner ends 20 as shown in FIGS. 12 and 13 are intended for instruments with thinner bodies, such as some electric guitars.

As noted above, it is preferable to hang the instrument so that the body of the instrument is adjacent to and nearly touching the wall. By hanging the instrument close to the wall, the body of the instrument will engage the wall if the instrument is accidentally twisted. The engagement of the instrument body with the wall prevents the head 22 (FIG. 2) or 40 (FIG. 6) from twisting to such an extent that the head may slip through the pegs 12, 13. Referring again to FIG. 4, each peg 12, 13 is mounted to the base plate 11 by a screw 37, 38 which extends through the slot 32, 33 and down the axial center of each peg 12, 13 respectively. As seen in FIGS. 3 and 4, hexagonal screws or bolts 37, 38 are preferred because the heads 25, 26 engage the sides of the slots 32, 33 and thereby permit tightening of the pegs 12, 13 by twisting the pegs 12, 13, not the screws 37, 38. In this way, the pegs 12, 13 may be loosened, adjusted and retightened while the rack 10 is mounted to the wall. Upon tightening the screws 37, 38 in the pegs 12, 13, the screw heads 25, 26 positively engage the bottom surfaces 35, 36 of the slots 32, 33 respectively.

In contrast to the wider displacement of the pegs 12, 13 shown in FIG. 2, FIG. 5 is an illustration of a narrower displacement of the pegs 12, 13 with the pegs 12, 13 at different elevations to accommodate the guitar head 41/neck 42 combination of the guitar 40 shown in phantom in FIG. 6. As seen in FIG. 6, if the pegs 12, 13 were adjusted to the same vertical level, the guitar 40 would not hang in a straight manner, but would hang at an angle from the rack 10. FIG. 7 is a rear side view of the guitar rack 10 orientation shown in FIG. 6 with the screw heads 25, 26 disposed in the upper end 43 of slot 32 and the screw head 26 disposed in the lower end 44 of the slot 33.

FIG. 9 is an illustration of the left slot 32 shown in FIGS. 3 and 7. FIG. 10 illustrates the vertical passageway 34 and FIG. 11 illustrates the horizontal passageway 29. FIGS. 12 and 13 illustrate the incorporation of a thinner extension 20*a* for use with smaller stringed instruments or thinner guitars such as electric guitars.

An additional accessory that should be supplied with the rack 10 is a self-sticking felt pad for placement on the wall where the guitar or instrument body engages the wall. The felt pad will prevent the transfer of any paint from the wall to the instrument.

Thus, one aesthetically pleasing instrument rack is provided for the mounting and hanging of stringed instruments from a wall in a home, apartment, office or museum. The rack is adjustable to accommodate different stringed instruments including guitars of different sizes, both acoustic and electric. Of course, other instruments in addition to guitars can be hung from a wall using the rack of the present invention. The rack provides an attractive means for displaying an instrument that provides protection for the instrument while keeping the instrument in an accessible location.

Although only one preferred embodiment of the present invention has been illustrated and described, it will at once be apparent to those skilled in the art that variations may be made within the spirit and scope of the invention. Accordingly, it is intended that the scope of the invention be limited solely by the scope of the hereafter appended claims and not by any specific wording in the foregoing description.

I claim:

1. A rack for hanging a stringed instrument on a substantially vertical wall, the instrument including a neck and a head disposed on a distal end of the neck, the rack comprising:

a base plate including a front surface and a rear surface, the base plate including means for mounting the base plate to the wall, the rear surface of the base plate engaging the wall when the base plate is mounted to the wall, means for mounting two pegs to the front surface of the base plate, each peg having a lateral and vertical position with respect to the other peg, the means for mounting the two pegs enabling adjustment of the lateral and the vertical positions of the pegs with respect to each other and wherein the means for mounting the two pegs includes two slots disposed in and extending through the base plate, at least one slot having a vertical portion and a lateral portion thereby allowing adjustment of the vertical and lateral position of one peg with respect to the other peg, the two pegs extending substantially perpendicularly outward from the front surface of the base plate, the two pegs supporting the head of the instrument, the instrument hanging from the pegs and juxtaposed to the wall.

2. The rack of claim 1, wherein each slot having a vertical portion and a lateral portion thereby allowing adjustment of the vertical and lateral positions of each peg with respect to the other peg.

3. The rack of claim 2, wherein the means for mounting the two pegs further includes two screws, each screw extending through a slot and through a peg, each screw having a head that is wider than the slot, the screws positively engaging the slots upon tightening to securely mount the pegs to the base plate.

4. The rack of claim 2, wherein each peg includes a distal end, an inner end, and a middle portion, the inner ends of the pegs covering the slots.

5. The rack of claim 4, wherein the distal end, the inner end and the middle portion of each peg having an outer periphery, the outer periphery of the distal and inner ends being larger than the outer periphery of the middle portion, the outer periphery of the inner end covering the slot, the outer periphery of the distal end precluding the head of the instrument from falling out of the rack.

6. The rack of claim 4, wherein the inner end of each peg is a separate extension attached thereto.

7. The rack of claim 6, wherein each peg includes an overall length, the overall length of each peg being short enough so as to preclude the instrument from rotating 90 when the instrument is hanging from the pegs without the instrument first engaging the wall.

8. The rack of claim 7, wherein the overall length of each peg is adjustable by substitution of inner ends of different lengths.

9. The rack of claim 5, wherein each middle portion is covered with a polymeric material to prevent damage to the neck and the head of the instrument.

10. A rack for hanging a musical string instrument on a substantially vertical wall, the instrument including a neck and a head disposed on a distal end of the neck, the rack comprising:

a base plate including a front surface and a rear surface, the base plate including means for mounting the base plate to the wall, the rear surface of the base plate engaging the wall when the base plate is mounted to the wall, the base plate including two slots, each slot for mounting a pegs to the front surface of the base plate, each peg having a lateral and vertical position with respect to the other peg, each slot having a vertical portion and a lateral portion thereby allowing adjustment of the vertical and lateral position of each peg with respect to the other peg, the two pegs extending substantially perpendicularly outward from the front surface of the base plate, each peg being mounted to the base plate with a screw extending through a slot and through a horizontal axis of the peg, each screw having a head that is wider than the slot, the screws positively engaging the slots upon tightening of the screws in the pegs to securely mount the pegs to the base plate, the two pegs supporting the head of the instrument, the instrument hanging from the pegs and substantially parallel and adjacent to the wall.

11. The rack of claim 10, wherein each peg includes a distal end, an inner end, and a middle portion, the inner end of the pegs covering the slots.

12. The rack of claim 10, wherein the distal end, the inner end and the middle portion of each peg having an outer periphery, the outer periphery of the distal and inner ends being larger than the outer periphery of the middle portion, the outer periphery of each inner end covering a slot, the outer periphery of the distal end precluding the head of a stringed musical instrument from falling out of the rack.

13. The rack of claim 12, wherein each middle portion is covered with a polymeric material to prevent damage to the neck and the head of the instrument.

14. The rack of claim 11, wherein each peg includes an overall length, the overall length of each peg being short enough so that the instrument cannot substantially rotate when the instrument is hanging from the pegs without first engaging the wall.

15. A rack for hanging a stringed instrument on a substantially vertical wall, the instrument including a neck and a head disposed on a distal end of the neck, the rack comprising:

a base plate including a front surface and a rear surface, the base plate including means for mounting the base plate to the wall, the rear surface of the base plate engaging the wall when the base plate is mounted to the wall, means for mounting two pegs to the front surface of the base plate, each peg having a lateral and vertical position with respect to the other peg, the means for mounting the two page to the front surface of the base plate includes two slots disposed in and extending through the base plate, at least one slot having a vertical portion and at least one slot having a lateral portion thereby allowing adjustment of the vertical and lateral positions of the pegs with respect to each other, the two pegs supporting the head of the instrument, the instrument hanging from the pegs and juxtaposed to the wall.

16. A rack for handing a stringed instrument on a wall, the instrument including a neck and a head disposed on a distal end of the neck, the rack comprising:

a base plate including a front surface, means for mounting two pegs to the front surface of the base plate, each peg having a lateral and vertical position with respect to the other peg, the means for mounting the two pegs includes two slot means disposed in and extending through the base plate, at least one slot means having a vertical portion and at least one slot means having a lateral portion thereby allowing adjustment of the vertical and lateral positions of the pegs with respect to each other, the two pegs supporting the head of the instrument.

* * * * *